US009196440B2

(12) United States Patent
Lee

(10) Patent No.: US 9,196,440 B2
(45) Date of Patent: Nov. 24, 2015

(54) PORTABLE ELECTRONIC DEVICE CAPABLE OF SWITCHING DIFFERENT STATUSES BY CENTRIFUGAL FORCE

(71) Applicant: Wistron Corporation, New Taipei (TW)

(72) Inventor: Hsu-Ming Lee, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 456 days.

(21) Appl. No.: 13/760,087

(22) Filed: Feb. 6, 2013

(65) Prior Publication Data

US 2014/0103741 A1 Apr. 17, 2014

(30) Foreign Application Priority Data

Oct. 16, 2012 (TW) ..... 101138067 A

(51) Int. Cl.
*H01H 35/10* (2006.01)
*H01H 35/00* (2006.01)

(52) U.S. Cl.
CPC ..... *H01H 35/00* (2013.01); *H01H 35/10* (2013.01); *Y10T 307/793* (2015.04)

(58) Field of Classification Search
CPC ..... G01P 13/00; G01P 3/16; H01H 35/10
USPC ..... 307/120
See application file for complete search history.

(56) References Cited

U.S. PATENT DOCUMENTS

| | | | | | |
|---|---|---|---|---|---|
| 1,896,798 | A * | 2/1933 | Leslie | 200/80 R | |
| 3,286,057 | A * | 11/1966 | Krupen | 200/80 R | |
| 4,479,041 | A * | 10/1984 | Fenwick et al. | 200/81 R | |
| 5,059,958 | A * | 10/1991 | Jacobs | G06F 3/0338 200/61.47 | |
| 6,665,802 | B1 | 12/2003 | Ober | | |
| 7,450,025 | B2 * | 11/2008 | Fong | H01H 35/025 200/52 R | |
| 2005/0216867 | A1 * | 9/2005 | Marvit et al. | 715/863 | |
| 2009/0088204 | A1 * | 4/2009 | Culbert | G06F 3/017 455/556.1 | |
| 2011/0175805 | A1 * | 7/2011 | Rottler et al. | 345/156 | |

* cited by examiner

*Primary Examiner* — Jared Fureman
*Assistant Examiner* — Brett Squires
(74) *Attorney, Agent, or Firm* — Winston Hsu; Scott Margo

(57) ABSTRACT

A portable electronic device includes a casing, four actuating mechanisms and a control module. The four actuating mechanisms are disposed inside the casing. Each actuating mechanism includes a slot structure and an actuating component. The actuating component is disposed on an end of the corresponding slot structure. The control module is electrically connected to the four actuating mechanisms. The control module is for switching from a first status to a second status of the portable electronic device as the portable electronic device rotates in a rotating direction so as to drive each actuating component from the end of the slot structure to the other end of the slot structure due to centrifugal force.

11 Claims, 6 Drawing Sheets

PORTABLE ELECTRONIC DEVICE CAPABLE OF SWITCHING DIFFERENT STATUSES BY CENTRIFUGAL FORCE

BACKGROUND OF THE INVENTION

1. Field of the Invention

The present invention relates to a portable electronic device, and more specifically, to a portable electronic device capable of switching different statuses by centrifugal force.

2. Description of the Prior Art

In the modern market, a portable electronic device, such as a mobile phone, a tablet computer, and soon, is widely used in people's lives. A design trend of the portable electronic device is to be small and light and to dispose no hole on a casing of the portable electronic device. Some kinds of the portable electronic devices adopt built-in batteries, and there is no hole on the appearance of the casing, so that it can implement a small and light portable electronic device with the simple appearance. However, because the built-in battery of the portable electronic device is not detachable, as an operation system of the portable electronic device crashes and cannot be in operation, an user cannot remove the built-in battery from the portable electronic device to cut off electricity forcibly or cannot press a reset button inside a hole to solve a problem of a crashed operation system. Then the user has to wait for the portable electronic device to run out of electricity stored in the built-in battery to turn off the operation system, resulting in inconvenience of using the portable electronic device. Therefore, it is an important issue to design a system statuses switching mechanism applied to the portable electronic device with the built-in battery and without disposing the reset button.

SUMMARY OF THE INVENTION

The present invention is to provide a portable electronic device capable of switching different statuses by centrifugal force to solve above problems.

According to the disclosure, a portable electronic device includes a casing, four actuating mechanisms and a control module. The four actuating mechanisms are disposed inside the casing. Each actuating mechanism includes a slot structure and an actuating component. The actuating component is disposed on an end of the corresponding slot structure. The control module is electrically connected to the four actuating mechanisms. The control module is for switching from a first status to a second status of the portable electronic device as the portable electronic device rotates in a rotating direction so as to drive each actuating component from the end of the slot structure to the other end of the slot structure due to centrifugal force.

According to the disclosure, the four actuating mechanisms are electrically connected to the control module in an open-loop configuration as each actuating component is disposed on the end of each slot structure, so that the control module controls the portable electronic device to maintain in the first status.

According to the disclosure, the four actuating mechanisms are electrically connected to the control module in a closed-loop configuration as each actuating component moves from the end of each slot structure to the other end of each slot structure due to centrifugal force, so that the control module switches from the first status to the second status of the portable electronic device.

According to the disclosure, the second status is a system reset status.

According to the disclosure, the control module controls the portable electronic device to maintain in the first status as not all of the four actuating components are disposed on the end of the four slot structures.

According to the disclosure, each actuating mechanism further comprises a slip-resistant component disposed inside each slot structure, and the slip-resistant component is for resisting movement of the corresponding actuating component as the corresponding actuating component is disposed on the end of the corresponding slot structure.

According to the disclosure, the slip-resistant component is a sheathing component for sheathing the corresponding actuating component.

According to the disclosure, the four actuating mechanisms are respectively disposed on corners of the casing symmetrically.

According to the disclosure, the four actuating mechanisms are respectively disposed on four corners of the casing symmetrically.

According to the disclosure, the portable electronic device further includes a battery module electrically connected to the control module, and the control module is further for controlling the battery module to cut off electricity as each actuating component moves from the end of each slot structure to the other end of each slot structure due to centrifugal force, so that the portable electronic device switches from a power-on status to a power-off status.

According to the disclosure, the portable electronic device is a tablet computer or a smart phone.

An embodiment of the invention designs a mechanism with the four actuating mechanisms symmetrically disposed on the casing, so that the control module switches different statuses of the portable electronic device as each actuating component moves from the end of each slot structure to the other end of each slot structure. As a result, it can solve the problem that the user cannot take out the battery or press the reset button to turn off the operation system as the operation system of the portable electronic device, with the built-in battery and without disposing the reset button on the appearance, crashes. That is, the mechanical design of the present invention can be used for solving the problem of a crashed operation system effectively as the operation system cannot be in operation and cannot restart by cutting off electricity or turning off the operation system forcibly.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
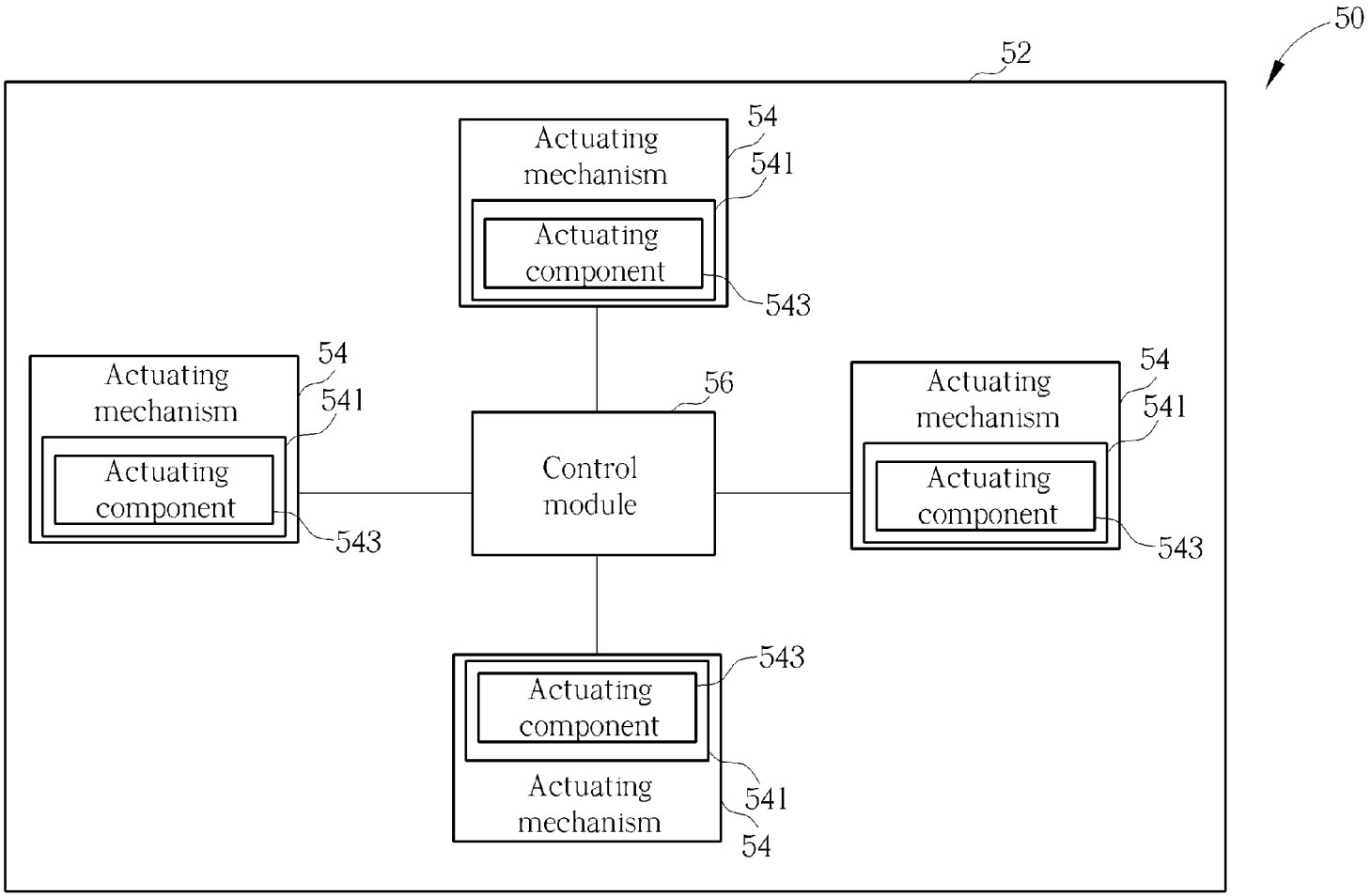
FIG. 1 is a functional block diagram of a portable electronic device according to an embodiment of the invention.
Figure 2:
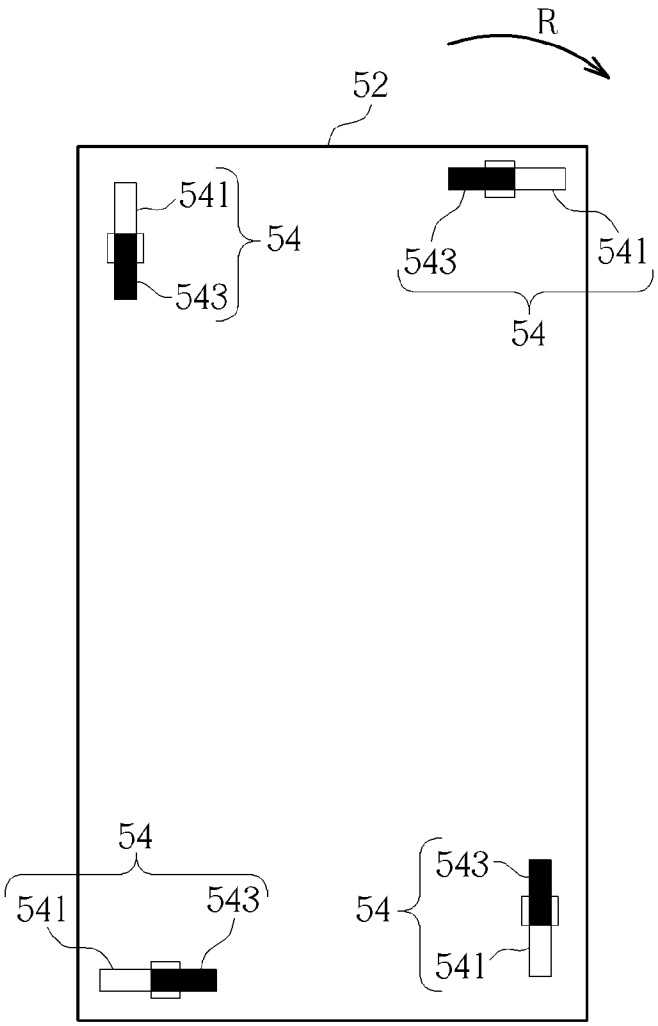
FIG. 2 is a partial diagram of the portable electronic device according to the embodiment of the invention.

Please refer to FIG. 1 and FIG. 2. FIG. 1 is a functional block diagram of a portable electronic device 50 according to an embodiment of the invention. FIG. 2 is a partial diagram of the portable electronic device 50 according to the embodiment of the invention. The portable electronic device 50 of the present invention includes a casing 52, four actuating mechanisms 54 and a control module 56. The portable electronic device 50 can be a tablet computer, a smart phone, and so on. It is implemented with a built-in battery, which is not detachable, and it can be designed to dispose no reset button on the casing 52 for resetting an operation system of the portable electronic device 50, so as to achieve a purpose of implementing the simple appearance. As shown in FIG. 2, the four actuating mechanisms 54 are disposed inside the casing 52. In this embodiment, the four actuating mechanisms 54 are respectively disposed on four corners of the casing 52 symmetrically, but are not limited to this configuration. That is, any symmetrical configuration is within the scope of the present invention. Each actuating mechanism 54 includes a slot structure 541 and an actuating component 543. The actuating component 543 is disposed on an end of the corresponding slot structure 541. For example, as shown in FIG. 2, the actuating component 543 on an upper right corner of the casing 52 is disposed on a left end of the corresponding slot structure 541, and the actuating component 543 can move along the slot structure 541. In this embodiment, the actuating component 543 can be a metal rod with electric conductivity, but is not limited to the metal rod. The control module 56 is electrically connected to the four actuating mechanisms 54 for switching from a first status to a second status of the portable electronic device 50 as the portable electronic device 50 rotates in a rotating direction R so as to drive each actuating component 543 from the end of the slot structure 541 to the other end of the slot structure 541 due to centrifugal force.

Figure 3:
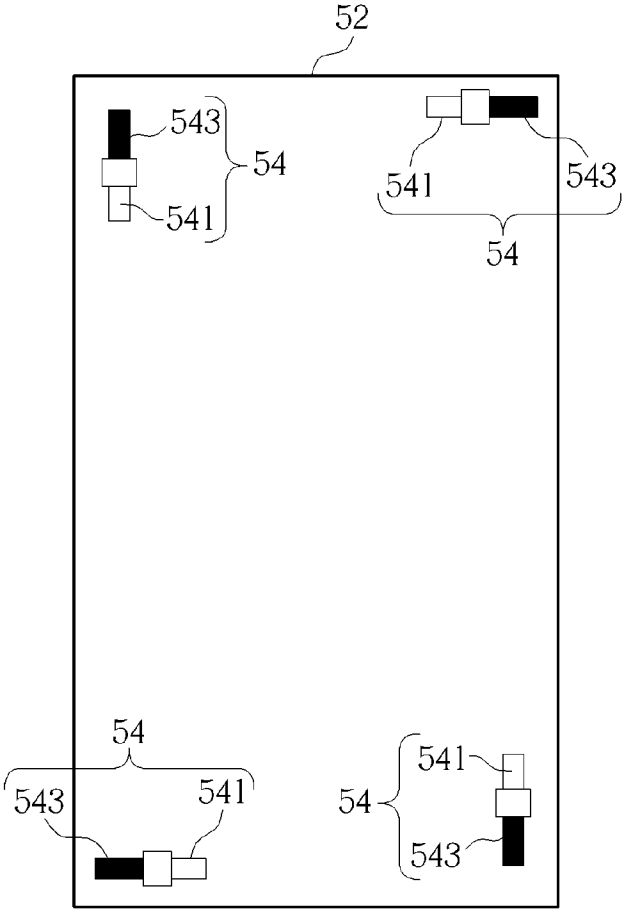
FIG. 3 is a diagram of an actuating component disposed on the other end of a slot structure according to the embodiment of the invention.

Please refer to FIG. 1 to FIG. 3. FIG. 3 is a diagram of the actuating component 543 disposed on the other end of the slot structure 541 according to the embodiment of the invention. In this embodiment, the present invention can solve a crash problem of the operation system. As the operation system crashes, the user can rotate the portable electronic device 50 in the rotating direction R illustrated in FIG. 2. At this time, the actuating component 543 originally disposed on the end of the slot structure 541 moves to the other end of the slot structure 541 as shown in FIG. 3 due to centrifugal force generated by a rotation. In this embodiment, the four actuating mechanisms 54 are electrically connected to the control module 56, and each actuating mechanism 54 can be used as a switch mechanism. For example, as shown in FIG. 2, it can design that all of the four actuating mechanisms 54 are electrically connected to the control module 56 in an open-loop configuration as each actuating component 543 is disposed on the end of the corresponding slot structure 541. As shown in FIG. 3, the four actuating mechanisms 54 are electrically connected to the control module 56 in a closed-loop configuration as each actuating component 543 is disposed on the other end of the corresponding slot structure 541.

As each actuating component 543 is disposed on the end of the corresponding slot structure 541, the control module 56 detects that the four actuating mechanisms 54 are electrically connected to the control module 56 in the open-loop configuration, and then the control module 56 controls the operation system of the portable electronic device 50 to maintain in the first status of a normal operation. As each actuating component 543 moves to the other end of the corresponding slot structure 541, the control module 56 detects that the four actuating mechanisms 54 are electrically connected to the control module 56 in the closed-loop configuration, so that the control module 56 switches from the first status to the second status of the portable electronic device 50 at this time. In this embodiment, the second status can be set as a system reset status. That is, as the control module 56 detects that the four actuating mechanisms 54 are electrically connected to the control module 56 in the closed-loop configuration, the control module 56 sends a reset signal to the operation system of the portable electronic device 50, so as to restart the operation system to solve the crash problem of the operation system.

Furthermore, it also can design that the four actuating mechanisms 54 are electrically connected to the control module 56 in the closed-loop configuration as each actuating component 543 is disposed on the end of the corresponding slot structure 541, and the four actuating mechanisms 54 are electrically connected to the control module 56 in the open-loop configuration as each actuating component 543 is disposed on the other end of the corresponding slot structure 541. As the control module 56 detects that the four actuating mechanisms 54 are electrically connected to the control module 56 in the closed-loop configuration, the control module 56 controls the operation system of the portable electronic device 50 to maintain in the first status of a normal operation. As each actuating component 543 moves to the other end of the corresponding slot structure 541, the control module 56 detects that the four actuating mechanisms 54 are electrically connected to the control module 56 in the open-loop configuration, so that the control module 56 switches from the first status to the second status of the portable electronic device 50. That is, as the control module 56 detects that the four actuating mechanisms 54 are electrically connected to the control module 56 in the open-loop configuration, the control module 56 sends the reset signal to the operation system of the portable electronic device 50, so as to restart the operation system to solve the crash problem of the operation system. As for determining which one of the two configurations to implement, it depends on practical design demands. Any switch mechanism by disposing the actuating component 543 on different positions of the slot structure 541 to achieve a switch function is within the scope of the present invention.

Figure 4:
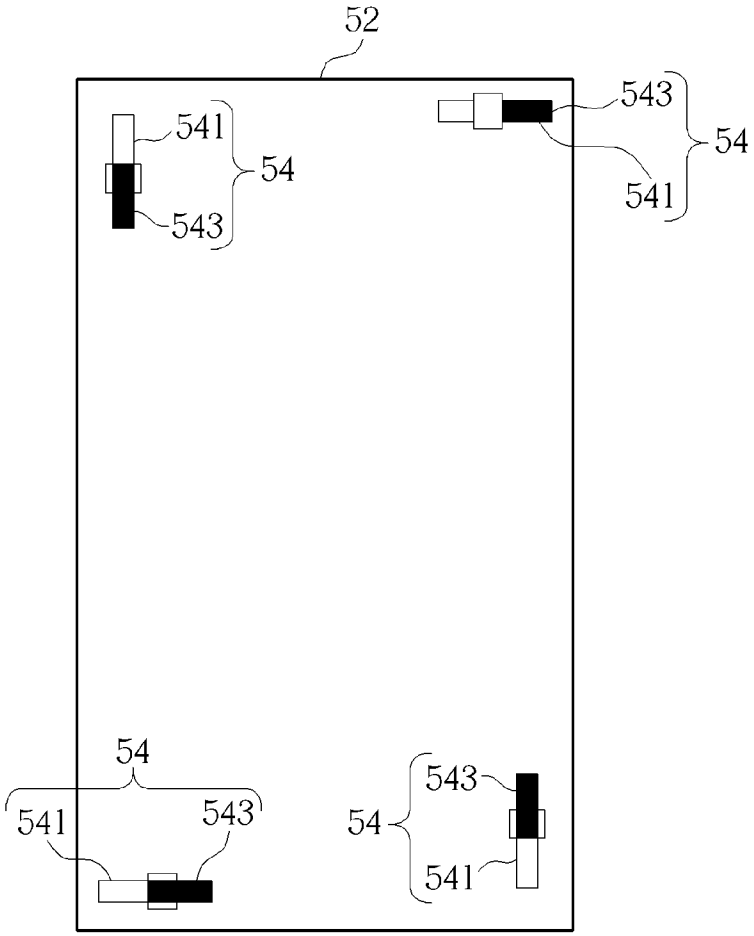
FIG. 4 is a diagram of the four actuating components indifferent positions according to the embodiment of the invention.

Please refer to FIG. 1, FIG. 2 and FIG. 4. FIG. 4 is a diagram of the four actuating components 543 in different positions according to the embodiment of the invention. In a normal operation of the portable electronic device 50, it is possible to generate unexpected centrifugal force because of shaking or rocking, so that not all of the four actuating components 543, as shown in FIG. 4, move to the other end of the slot structure 541 at the same time. At this time, the control module 56 detects that only one actuating mechanism 54 is electrically connected to the control module 56 in the closed-loop/or open-loop configuration, and the other three actuating mechanisms are electrically connected to the control module 56 in the open-loop/or closed-loop configuration, so that the control module 56 does not switch from the first status to the second status of the portable electronic device 50. That is, the control module 56 controls the portable electronic device 50 to maintain in the first status as not all of the four actuating components 543 are disposed on the end of the four slot structures 541 at the same time. This design can prevent the operation system from switching to the unexpected system reset status due to shaking or rocking as the user normally uses the portable electronic device 50.

It is noticed that a conductive component, not shown in figures, can be disposed on the other end of the slot structure 541 to implement the open-loop configuration and the closed-loop configuration of each actuating mechanism 54 in this embodiment. As each actuating component 543 is disposed on the end of the corresponding slot structure 541, the actuating component 543 does not contact the conductive component, so that the actuating component 543 is electrically connected to the control module 56 in the open-loop configuration. That is, each actuating mechanism 54 can be regarded as an open switch component in an electric circuit of the control module 56. As the actuating component 543 moves to the other end of the slot structure 541 to contact the conductive component, because the actuating component 543 in this embodiment is the metal rod, the actuating component 543 can complete the electric circuit of the control module 56 and the actuating mechanism 54, so that the actuating mechanism 54 is electrically connected to the control module 56 in the closed-loop configuration. In summary, it can implement the electric connection between the actuating mechanism 54 and the control module 56 in the open-loop configuration or in the open-loop configuration.

Figure 5:
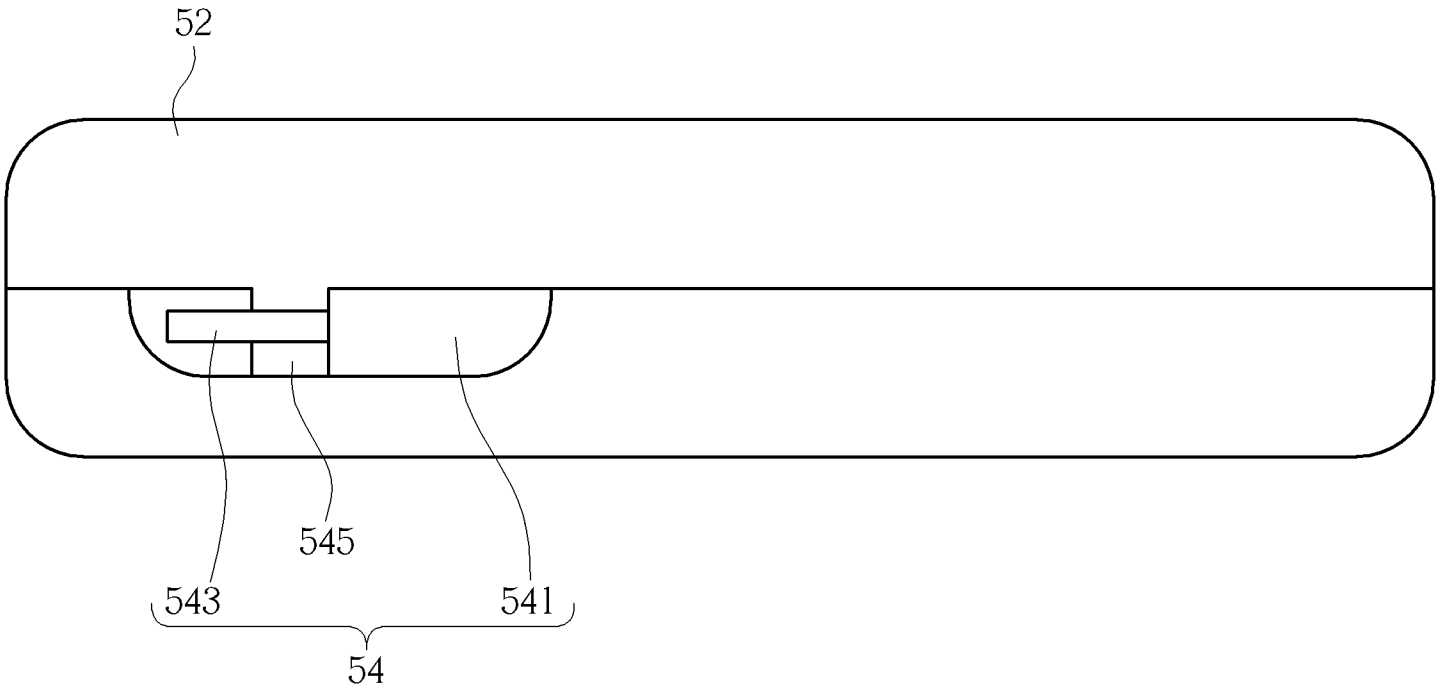
FIG. 5 is a sectional view of the slot structure and the actuating component according to the embodiment of the invention.

Please refer to FIG. 1 to FIG. 5. FIG. 5 is a sectional view of the slot structure 541 and the actuating component 543 according to the embodiment of the invention. As shown in FIG. 5, each actuating mechanism 54 further includes a slip-resistant component 545 disposed inside each slot structure 541. The slip-resistant component 545 can be a sheathing component for sheathing the corresponding actuating component 543. The slip-resistant component 545 is for resisting movement of the corresponding actuating component 543 as the corresponding actuating component 543 is disposed on the end of the corresponding slot structure 541. That is, in the normal operation, the slip-resistant component 545 can sheath the actuating component 543 to prevent the actuating component 543 from moving from the end of the slot structure 541 to the other end of the slot structure 541 unexpectedly, resulting in an error operation of all actuating mechanisms 54 electrically connected to the control module 56 in the closed-loop configuration. Therefore, it can prevent the control module 56 from performing a wrong operation so that the operation system switches to the unexpected system reset status.

Figure 6:
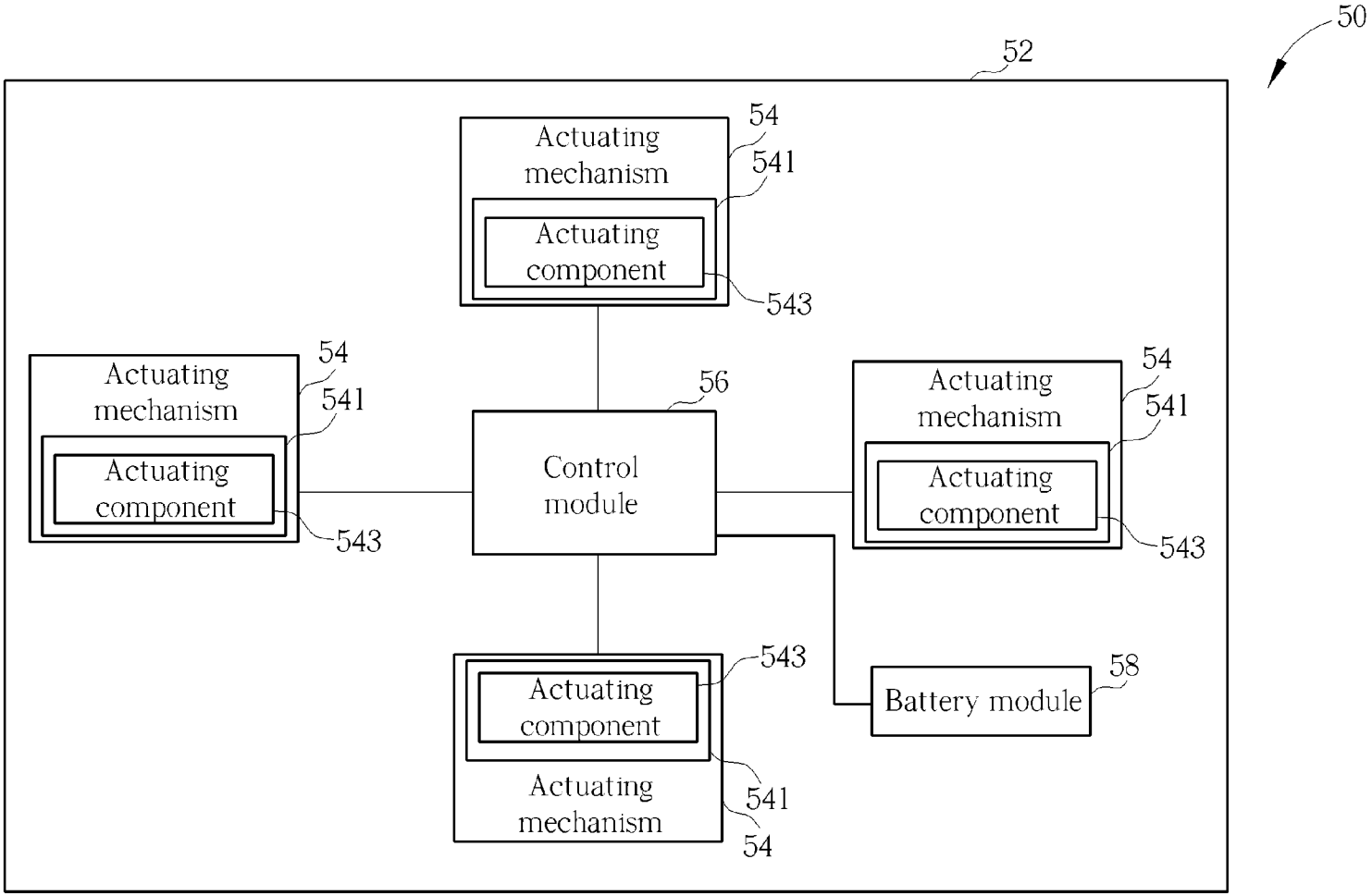
FIG. 6 is a functional block diagram of the portable electronic device according to another embodiment of the invention.

In addition, please refer to FIG. 6. FIG. 6 is a functional block diagram of the portable electronic device 50 according to another embodiment of the invention. A difference between this embodiment and the previous embodiment is that the portable electronic device 50 further includes a battery module 58 electrically connected to the control module 56, and the control module 56 is further for controlling the battery module 58 to cut off electricity as each actuating component 543 moves from the end of each slot structure 541 to the other end of each slot structure 541 due to centrifugal force, so that the portable electronic device 50 switches from a power-on status to a power-off status. That is, it can solve a problem that the user cannot take out the battery module 58 to cut off electricity forcibly or press the reset button to turn off the operation system as the operation system of the portable electronic device 50 crashes and cannot be in operation. Therefore, it does not need to wait for running out of remained electricity in the battery module 58 to turnoff the operation system, to solve the crash problem of the operation system in the prior art.

In contrast to the prior art, the present invention designs a mechanism with the four actuating mechanisms symmetrically disposed on the casing, so that the control module switches different statuses of the portable electronic device as each actuating component moves from the end of each slot structure to the other end of each slot structure. As a result, it can solve the problem that the user cannot take out the battery or press the reset button to turn off the operation system as the operation system of the portable electronic device, with the built-in battery and without disposing the reset button on the appearance, crashes. That is, the mechanical design of the present invention can be used for solving the problem of a crashed operation system effectively as the operation system cannot be in operation and cannot restart by cutting off electricity or turning off the operation system forcibly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A portable electronic device, comprising:

a casing;

four actuating mechanisms disposed inside the casing, each actuating mechanism comprising:

a slot structure; and an actuating component disposed on an end of the corresponding slot structure; and a control module electrically connected to the four actuating mechanisms for switching from a first status to a second status of the portable electronic device as the portable electronic device rotates in a rotating direction so as to drive each actuating component from the end of the slot structure to the other end of the slot structure due to centrifugal force, and when the portable electronic device stops rotating in the rotating direction, each actuating component is maintained at the other end of the slot structure, so as to remain the portable electronic device in the second status.

2. The portable electronic device of claim 1, wherein the four actuating mechanisms are electrically connected to the control module in an open-loop configuration as each actuating component is disposed on the end of each slot structure, so that the control module controls the portable electronic device to maintain in the first status.

3. The portable electronic device of claim 2, wherein the four actuating mechanisms are electrically connected to the control module in a closed-loop configuration as each actuating component moves from the end of each slot structure to the other end of each slot structure due to centrifugal force, so that the control module switches from the first status to the second status of the portable electronic device.

4. The portable electronic device of claim 1, wherein the second status is a system reset status.

5. The portable electronic device of claim 1, wherein the control module controls the portable electronic device to maintain in the first status as not all of the four actuating components are disposed on the end of the four slot structures.

6. The portable electronic device of claim 1, wherein each actuating mechanism further comprises a slip-resistant component disposed inside each slot structure, and the slip-resistant component is for resisting movement of the corresponding actuating component as the corresponding actuating component is disposed on the end of the corresponding slot structure.

7. The portable electronic device of claim 6, wherein the slip-resistant component is a sheathing component for sheathing the corresponding actuating component.

8. The portable electronic device of claim 1, wherein the four actuating mechanisms are respectively disposed on corners of the casing symmetrically.

9. The portable electronic device of claim 8, wherein the four actuating mechanisms are respectively disposed on four corners of the casing symmetrically.

10. The portable electronic device of claim 1, further comprising a battery module electrically connected to the control module, and the control module being further for controlling the battery module to cut off electricity as each actuating component moves from the end of each slot structure to the other end of each slot structure due to centrifugal force, so that the portable electronic device switches from a power-on status to a power-off status.

11. The portable electronic device of claim 1, wherein the portable electronic device is a tablet computer or a smart phone.

* * * * *